United States Patent [19]

Ikeda et al.

[11] 4,403,529

[45] Sep. 13, 1983

[54] DEVICE FOR FASTENING BOLTS

[75] Inventors: Seiji Ikeda, Osaka; Katsuyuki Ono, Moriguchi, both of Japan

[73] Assignee: Maeda Metal Industries Ltd., Osaka, Japan

[21] Appl. No.: 294,234

[22] Filed: Aug. 19, 1981

[51] Int. Cl.[3] ..... B25B 17/00

[52] U.S. Cl. ..... 81/56

[58] Field of Search ..... 81/55, 56

[56] References Cited

U.S. PATENT DOCUMENTS

| | | | |
|---|---|---|---|
| 2,928,302 | 3/1960 | Owen et al. . | |
| 3,041,902 | 7/1962 | Wing | 81/56 |
| 3,323,394 | 6/1967 | Bengerter et al. | 81/55 |
| 3,323,395 | 6/1967 | Burnett et al. | 81/55 |

FOREIGN PATENT DOCUMENTS

| | | |
|---|---|---|
| 49-29598 | 3/1974 | Japan . |
| 51-57393 | 5/1976 | Japan . |
| 52-36640 | 9/1977 | Japan . |

*Primary Examiner*—James L. Jones, Jr.

*Attorney, Agent, or Firm*—Armstrong, Nikaido, Marmelstein & Kubovcik

[57] ABSTRACT

A device for fastening a bolt having a tip to be sheared therefrom comprises an outer socket engageable with a nut on the bolt, an inner socket engageable with the tip and retractably disposed in the outer socket, and stoppers provided between the inner socket and the outer socket for preventing the inner socket from retraction. When the tip is properly fitted into the inner socket, the stoppers are disengaged to permit the retraction of the inner socket and render the nut fittable in the outer socket.

5 Claims, 10 Drawing Figures

DEVICE FOR FASTENING BOLTS

BACKGROUND OF THE INVENTION

The present invention relates to a device for fastening a special bolt having a tip which is sheared when subjected to torque exceeding a predetermined magnitude so that the bolt can be fastened by specified torque.

A torque control bolt 9 shown in FIG. 6 has heretofore been used which can be fastened by specified torque to avoid variations in the bolt fastening force and loosening.

The torque control bolt is formed, at the forward end of its threaded shank 94, with a tip 91 to be sheared. When the bolt is fastened with a device designed specifically therefor and subjected to torque exceeding a predetermined magnitude, a stress concentrates on the bottom of a circumferential groove 95 between the threaded shank 94 and the tip 91, and the tip 91 is sheared at the groove 95 by a maximum shearing stress which is dependent on the shape of the groove 95. Accordingly whether the tip 91 is sheared or not apparently indicates whether or not the bolt is completely fastened.

Devices designed specifically for torque control bolts are disclosed, for example, in U.S. Pat. No. 2,928,302, and Japanese Utility Model Application No. 75667/1972 (Published Unexamined Utility Model Application No. 29598/1974) as shown in FIG. 7. Such a disclosed fastening device includes at its forward end an inner socket 6 and an outer socket 7 which are coupled to a drive assembly 1. The inner socket is fitted to the tip 91 to be sheared from the forward end of the bolt shank, and the outer socket is fitted to a nut screwed on the bolt. The drive assembly 1 is operated while causing the bolt tip to withstand the fastening reaction of the nut through the inner socket. The fastening torque of the nut relative to the bolt is controlled by the shearing of the bolt tip. The fastening device described, however, is not provided with means for preventing incomplete fitting of the bolt tip 91 in the inner socket 6, so that the bolt is likely to be fastened, with the bolt tip incompletely fitted in the inner socket because the bolt tip is concealed by the outer socket 7 and unseen from outside.

If the fastening device is operated without fitting the tip fully into the inner socket, i.e. with the tip positioned to receive pressure from the innner socket over a small area, the tip is subjected to an increased surface pressure and becomes unable to withstand the torque, which blunts the ridges of the tip, permitting the tip to rotate idly relative to the socket. This gives rise to the problem that the deformed tip renders the bolt itself no longer reusable, causes damage to the inner surface of the socket and allows the fastening reaction to act inadvertently on the operator by way of the fastening device, hence hazardous.

Further with the fastening device described, the outer socket 7 is fitted to the nut after the inner socket has been fitted to the bolt tip, by supporting the device main body with one hand while pressing the main body toward the bolt, and turning the outer socket 7 with the other hand to fit the socket around the hexagonal nut. This procedure is cumbersome, inefficient and causes fatigue to the operator.

As the nut is screwed on the bolt during the operation of the fastening device, the threaded shank 94 of the bolt progressively moves outward from the surface of the nut. To accommodate the axial movement of the bolt, the fastening device of FIG. 7 includes a holder 3 coupled to the drive assembly 1 and formed with a hexagonal bore 30 as seen in FIG. 8, and the inner socket 6, which is in the form of a hexagonal rod, is slidably fitted in the bore 30, such that as the threaded shank 94 of the bolt 9 moves outward from the nut 92, the inner socket 6 is retracted into the holder 3.

However, when the holder 3 rotates in the direction of an arrow, the corners 68 of the inner socket 6 come into line-to-line contact with the inner surface of the holder 3 since there is a clearance 36 between the inner surface of the holder 3 and the outer surface of the inner socket 6 for permitting sliding.

If torque of increased magnitude acts on the holder 3 which is thus in line-to-line contact with the inner socket 6, the corners 68 of the inner socket 6 will tightly press the holder 3 as if biting in its inner surface, impeding the axial movement of the inner socket, which is therefore unable to retract smoothly. Furthermore, the holder 3, when not having a large wall thickness, fails to withstand the pressure of the corners 68 and is likely to break.

When great frictional resistance acts on the inner socket against its axial movement, the drive assembly 1 will be heavily loaded. The necessity to make the assembly 1 large-sized and the large wall thickness of the holder 3 tend to render the fastening device large-sized in its entirety.

SUMMARY OF THE INVENTION

An object of the present invention is to eliminate the problems encountered with conventional fastening devices by providing means for preventing incomplete fitting of a bolt tip by which a nut is made fittable in an outer socket only when the bolt tip is entirely completely fitted in an inner socket, the preventing means thus overcoming the conventional problems, preventing damage to the socket and improving the safety of operation.

Another object of the invention is to provide a nut fastening device wherein a nut can be easily fitted into an outer socket merely by turning the main body of the fastening device after a tip to be sheared has been engaged in an inner socket.

Another object of the invention is to provide a lightweight and compact fastening device which has a small-sized drive means incorporated therein and in which an inner socket is smoothly retractable into a holder when fastening a bolt, without heavily loading the drive means.

DETAILED DESCRIPTION OF THE INVENTION

Figure 1:
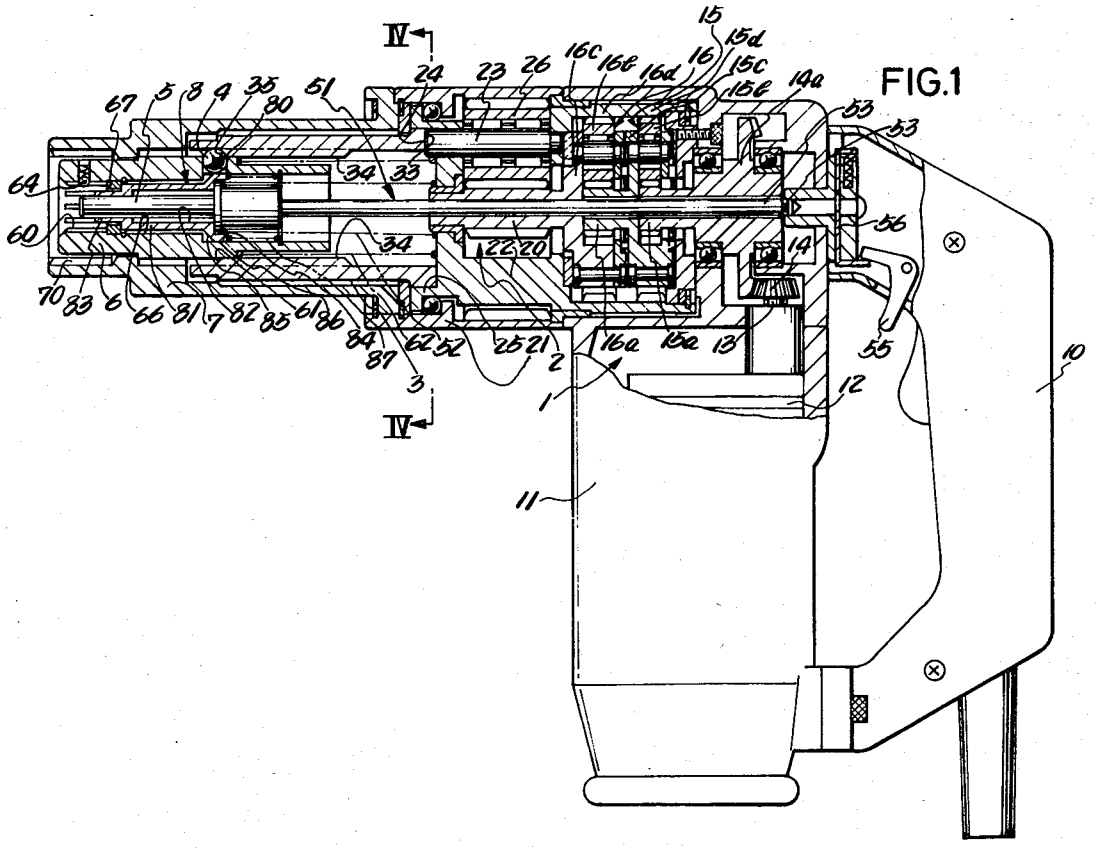
FIG. 1 is a sectional view showing a fastening device of this invention.
Figure 2:
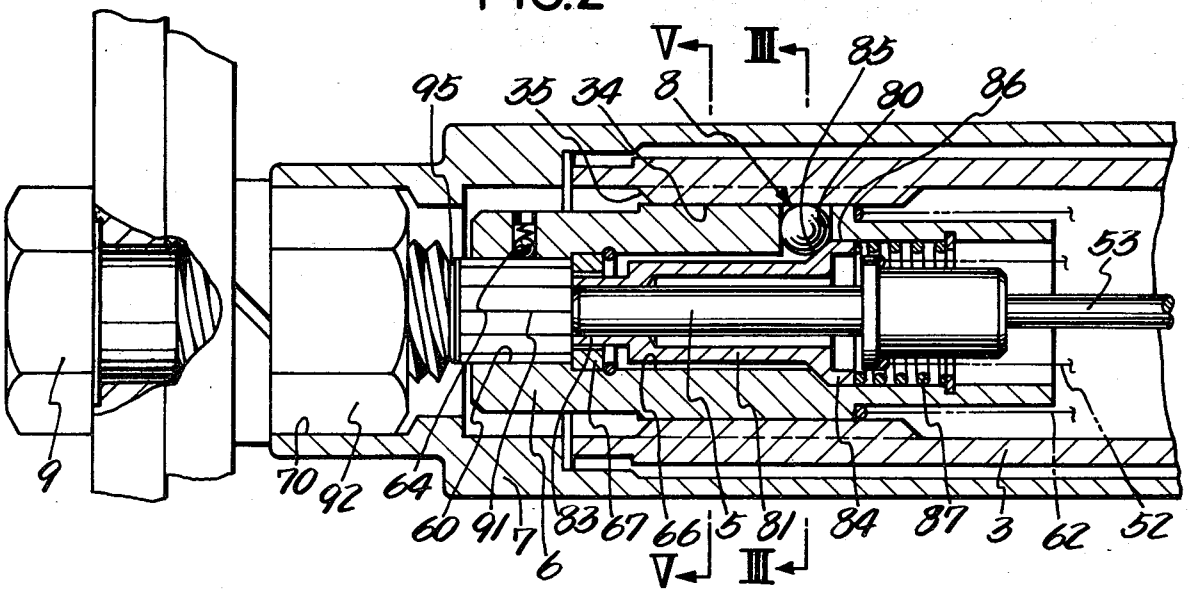
FIG. 2 is a fragmentary view in section showing the fastening device with a bolt and nut engaged therein.

A bolt fastening device comprises a rotatingly driving assembly 1 housed in a casing 11, and an inner socket 6 and an outer socket 7 which are arranged concentrically at a right angle to the casing 11.

The driving assembly 1 comprises a drive motor 12 and planetary gear means 15, 16, 2 arranged in three stages for transmitting the rotation of the motor 12 to the inner socket 6 and the outer socket 7. The rotary shaft 13 of the motor 12 is coupled via bevel gears **14, 14*a* to a sun gear 15*a* of the planetary gear means 15 in the first stage. A support frame 15*c* for planetary gears 15*b* of the first-stage planetary gear means 15 is integral with a sun gear 16*a* of the planetary gear means 16 in the second stage. A support frame 16*c* for planetary gears 16*b* of the gear means 16 is integral with a sun gear 20 of the planetary gear means 2 in the last stage. A support frame 22 for planetary gears 26 of the last-stage planetary gear means 2 is integral with inner gears 15*d*, 16*d* of the planetary gear means 15, 16** in the first and second stages.

The outer socket 7 is connected to an inner gear 21 of the planetary gear means 2.

The forward ends 24 of planetary gear shafts 23 are projected outward from the support frame 22 of the gear means 2. A short tubular portion 25 extends from the outer periphery of the frame 22.

The tubular portion 25 has rotatably fitted therein the base end of a holder 3, which in turn has the inner socket 6 slidably fitted therein. In corresponding relation to the planetary gear shafts 23 on the support frame 22, the base end of the holder 3 is formed with cutout portions 22 having a depth approximately equal to the length of projection of the shafts 23 and a circumferential width larger than the diameter of the shafts 23. The forward ends 24 of the shafts 23 are loosely fitted in the cutout portions 33.

Accordingly the holder 3 is freely turnable relative to the support frame 22 by an amount corresponding to a space 31 produced between the cutout portion 33 and the shaft 23.

Figure 5:
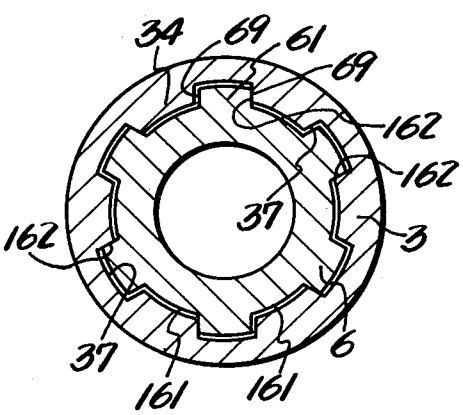
FIG. 5 is a view in section taken along the line V—V in FIG. 2.
Figure 6:
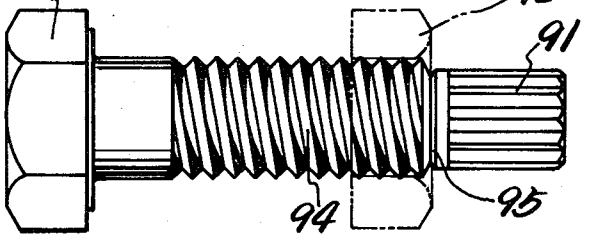
FIG.6 PRIOR ART
FIG. 6 is a front view of a torque control bolt.
Figure 7:
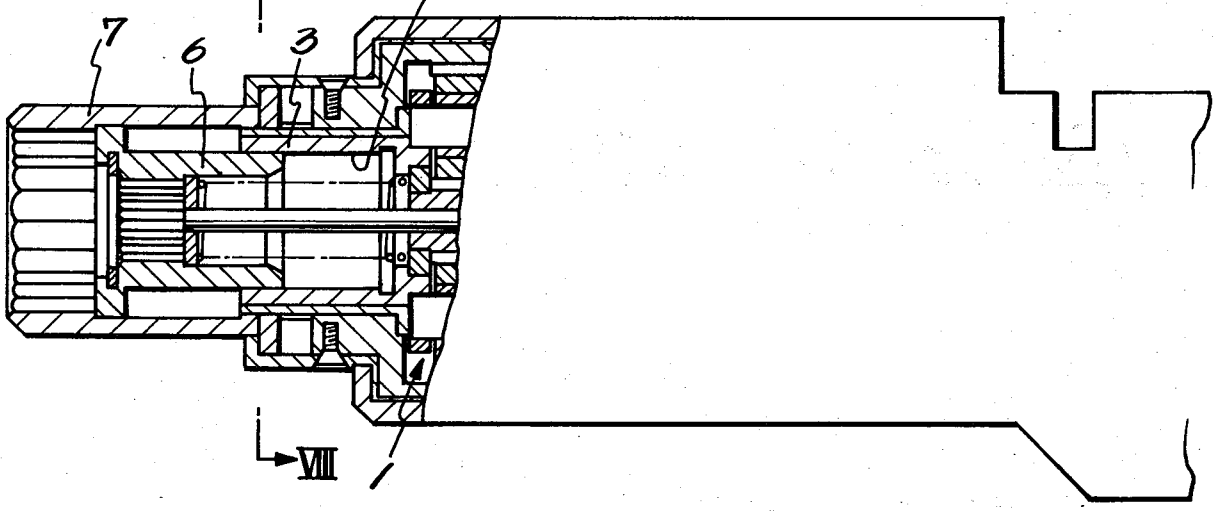
FIG.7 PRIOR ART
FIG. 7 is a fragmentary view in section showing a conventional fastening device.

As seen in FIG. 5, axial projections 61 and 34 arranged equidistantly and formed on the outer periphery of the inner socket 6 and the inner periphery of the holder 3, respectively, are slidably fitted in grooves 37 and 161 formed between the opposite projections to fit the socket 6 in the holder 3. The faces 69 and 162 of the projections 61 and 34 in contact with each other are inclined at an angle of up to 15 degrees with respect to a line through the axis.

The inner socket 6 is biased forward by a spring 62 with its forward end projected into a nut engaging bore 70 at the forward end of the outer socket 7.

Some of the projections 34 on the holder 3 are formed, each at its forward end, with a bearing face 35 engageable with a spherical stopper 4 as will be described later.

When the motor 12 of the driving assembly 1 is actuated with the inner socket 6 prevented from rotation by an external force exerted thereon, the inner gear 21 of the planetary gear means 2, i.e. the outer socket 7, is rotated at a reduced speed. Conversely if the motor is driven with the outer socket 7 prevented from rotation by an external force exerted thereon, the inner socket 6 is rotated in an opposite direction by the support frame 22 of the gear means 2.

Further when the fastening device is turned about its axis in its entirety, with the motor 12 deenergized and the inner socket 6 held stationary, the planetary gear support frame 22 turns by an amount corresponding to the length of the spaces 31 relative to the holder 3 for the inner socket 6, consequently turning the outer socket 7 reversely.

At the forward end of the inner socket 6, a ball 64 is retractably projected from the inner surface of the socket by being loaded with a spring. When the fastening device is removed from a bolt 9 after a bolt tip 91 has been broken off within the inner socket 6, the ball 64 retains the tip 91 in the inner socket 6 to prevent the tip 91 from slipping off inadvertently.

Means 8 for preventing incomplete fitting of the bolt tip is provided between the inner socket 6 and the holder 3. The means 8 comprises stoppers 4 in the form of a steel ball and fitting in holes 80 in the side wall of the inner socket 6, and a tubular rod 81 slidably disposed in an inner bore 66 of the inner socket 6 for moving the stoppers 4.

The hole 80 having the stopper 4 fitted therein extends through the side wall of the inner socket 6 and is opposed to the bearing face 35 of the holder 3 when the inner socket 6 is in its advanced position. The stopper 4 is retractable into or projectable from the hole 80.

At the boundary between the inner bore 66 of the inner socket 6 and a tip engaging bore 60 thereof, a stop ring 67 is provided for restraining forward movement of the tubular rod 81. The tubular rod 81 has at its forward end a projecting portion 83 slidingly movable through the stop ring 67 into the tip engaging bore 60 and is formed at its base end with an operating portion 84 in the form of a flange for retractably projecting the stoppers 4 from the holes 80.

The operating portion 84 has a rearwardly sloping conical cam face 85 and an engaging face 86 extending from the outer periphery of the cam face 85 in parallel to the axis of the tubular rod 81.

The tubular rod 81 is biased forward by a spring 87. When the tubular rod 81 is brought to its advanced position into abutting contact with the stop ring 67 with the projecting portion 83 advanced into the tip engaging bore 60, the stoppers 4 slide along the cam face 85 of the operating portion 84, ride on the engaging face 86 to project from the outer periphery of the inner socket 6 and engage with the bearing faces 35 inside the holder 3.

A knockout pin 5 retractably extending through the tubular rod 81 is coupled to a knockout assembly 51. The knockout assembly 51 comprises a spring 52 for biasing the knockout pin 5 forward, a knockout rod 53 projecting from the rear end of the pin 5, slidably extending through the sun gears **20, 16*a*, 15*a* of the planetary gear means 15, 16, 2 and formed with an engaging groove 54 at its rear end, and a latch 56 coupled to a trigger 55 attached to a handle 10 of the fastening device and positioned in the path of movement of the knockout rod 53. When the knockout pin 5, i.e. the knockout rod 53, is retracted compressing the spring 52, the latch 56 engages in the groove 54 of the rod 53, while when the trigger 55 is pulled, the latch 56 is disengaged from the groove 54, causing the spring to advance the knockout rod 53, i.e. the pin 5**.

The bolt fastening device of this invention having the foregoing construction will be described below as it is in a state before fitting to a bolt, as fitted properly to a bolt and as it is not properly fitted to a bolt.

Before Fitting

As shown in FIG. 1, the inner socket 6 is biased by the spring 62 with its forward end projected into the nut engaging bore 70 of the outer socket 7.

The tubular rod 81, which is biased by the spring 87, has its forward end projecting portion 83 positioned in the tip engaging bore 60 of the inner socket 6. The knockout pin 5 is biased by the spring 52 with its forward end projected from the tubular rod 81.

The operating portion 84 on the outer periphery of the tubular rod 81 holds the stoppers 4 in an outward raised position in engagement with the bearing faces 35 of the holder 3.

In this state, the inner socket 6 is prevented from retraction by the stoppers 4 in engagement with the holder 3.

When Properly Fitting

When a nut is to be fastened onto a bolt, the engaging bore 60 of the inner socket 6 is fitted to the tip 91 of the bolt.

The tip 91 inserted retracts the knockout pin 5 and the tubular rod 81 from the socket 6 while compressing the springs 52 and 87. When the bolt tip 91 has been completely fitted into the bore 60 and the tubular rod 81 retracted, the stoppers 4 are released from the operating portion 84 of the tubular rod 81 and retract fully into the holes 80 in the inner socket 6 out of engagement with the holder 3, so that the inner socket 6 having the tip 91 fitted therein retracts into the holder 3, permitting the nut 92 on the bolt 9 to fit into the bore 70 of the outer socket.

When Not Properly Fitting

Figure 4:
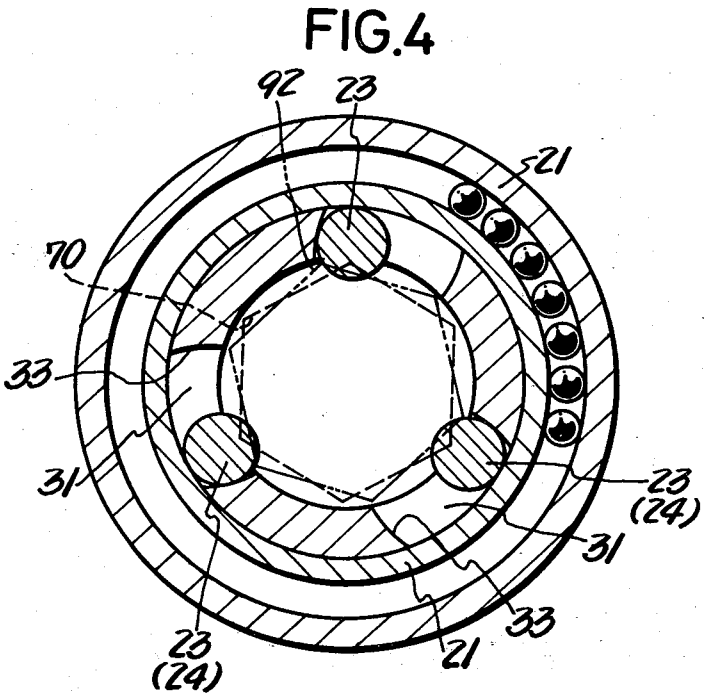
FIG. 4 is a view in section taken along the line IV—IV in FIG. 1.
Figure 3:
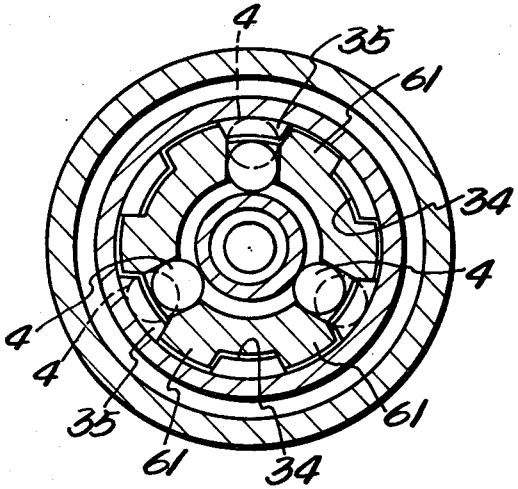
FIG. 3 is a view in section taken along the line III—III in FIG. 2.

When the nut engaging bore 70 is not in phase with the nut 92 as indicated in broken lines in FIG. 4, the nut 92 will not fit into the outer socket 7. If the motor 12 is driven in this state, the outer socket 7 will rotate only idly.

When the fastening device grasped by hand is turned about its axis in positive or reverse direction, the inner socket 6 remains stationary in engagement with the bolt 9. Consequently the planetary gear support frame 22 turns by an amount by which the forward ends 24 of the gear shafts 23 are movable in the spaces 31 of the cutout portions 33 in the holder 3.

At this time, the planetary gears 26 on the shafts 23 reversely rotate the inner gear 21 meshing therewith, i.e. the outer socket 7, by an amount corresponding to the amount of turn of the fastening device. Thus the nut engaging bore 70 can be brought into phase with the nut 92 for fitting without gripping the outer socket 7 with hand for adjustment.

When the inner socket 6 is fully fitted to the bolt tip 91 and the outer socket 7 to the nut 92, the latch 56 engages in the engaging groove 54 at the rear end of the knockout rod 53.

The bolt fastening device operates in the following manner for fastening.

Fastening of Nut

The driving assembly 1, when actuated, rotates the outer socket 7 at a reduced speed to fasten the nut 92 since the inner socket 6 remains stationary with the bolt tip 91 fitted therein. The fastening reaction is delivered through the inner socket 6 to the bolt tip 91, so that the nut 92 can be fully tightened up.

As the nut is progressively fastened, the threaded shank 94 of the bolt 9 projects from the surface of the nut. The movement of the shank 94 can be accommodated by the retraction of the inner socket 6 into the holder 3 against the spring 62.

Figure 8:
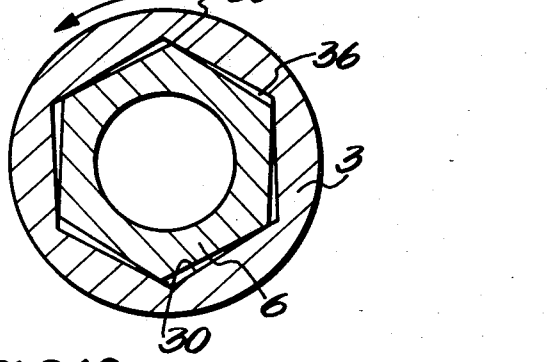
FIG.8 PRIOR ART
FIG. 8 is a view in section taken along the line VIII—VIII in FIG. 7.

The inner socket 6 and the holder 3 are in engagement with each other by the fitting of the projections 61, 34 in the opposed grooved portions 37, 161 in face-to-face contact, which involves much smaller frictional resistance to the axial movement of the inner socket 6 than is the case with the conventional device shown in FIG. 8 in which the corners 68 of the hexagonal inner socket 6 are in line-to-line contact with the inner surface of the holder 3. Accordingly the inner socket 6 is smoothly retractable into the holder 3 without subjecting the driving assembly 1 to a great load. Thus the driving assembly 1 can be small-sized.

Whereas the corners 68 of the conventional inner socket 6 exert a force on the inner surface of the holder 3 radially thereof, the holder of this invention, which is not subjected to such a force, can be of a reduced wall thickness.

Use of the driving assembly 1 which is small-sized and the holder 3 which has a small wall thickness renders the fastening device compact and lightweight.

While the face 69 of the projection 61 on the inner socket 6 in contact with the holder 3 is preferably positioned on a line through the axis thereof, our experiments have revealed that the inner socket 6 is smoothly slidable if the contact face is inclined at an angle of not larger than 15 degrees with respect to the line.

Shearing of Tip

When the nut has been fully tightened up, the nut 92 no longer rotates. As a result, the outer socket 7 comes to a halt in engagement with the nut 92, whereupon the inner socket 6 is subjected to a reaction which acts to turn the tip 91 in the bore 60 of the inner socket 6 toward a direction opposite to the direction in which the nut 92 is fastened.

At the limit of fastening, the stress concentrating on a circumferential groove 95 of the tip 91 exceeds an allowable range, whereupon the tip 91 is sheared at the groove 95. Consequently the bolt 9 and the nut 92 can be fastened by predetermined torque.

After fastening, the inner socket 6 remains in idle rotation with the sheared bolt tip 91 fitted therein. When the fastening device is removed from the nut, the spring 62 acts to project the forward end of the inner socket 6 into the nut engaging bore 70 of the outer socket 7.

Since the tubular rod 81 in the inner socket 6 is biased forward by the spring 87, the tubular rod 81 advances, following the movement of the inner socket 6.

Discharge of Tip

The trigger 55 is pulled, causing the spring 52 to advance the knockout rod 53, whereby the knockout pin 5 is advanced in the tubular rod 81 and projected into the bore 60. The sheared tip 91 is struck and discharged. At this time, the tubular rod 81 also advances, bringing the operating portion 84 thereof again to the position opposed to the holes 80 to partly project the stoppers 4 outward from the inner socket 6 into engagement with the bearing faces 35 of the holder 3. Thus the inner socket 6 is prevented from retraction in the same manner as already described.

Figure 10:
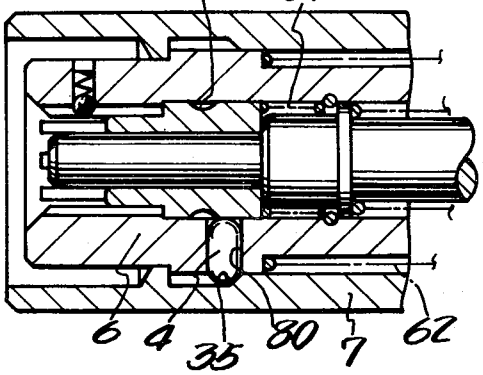
FIGS. 9 and 10 are sectional views showing other embodiments of the invention.
Figure 9:
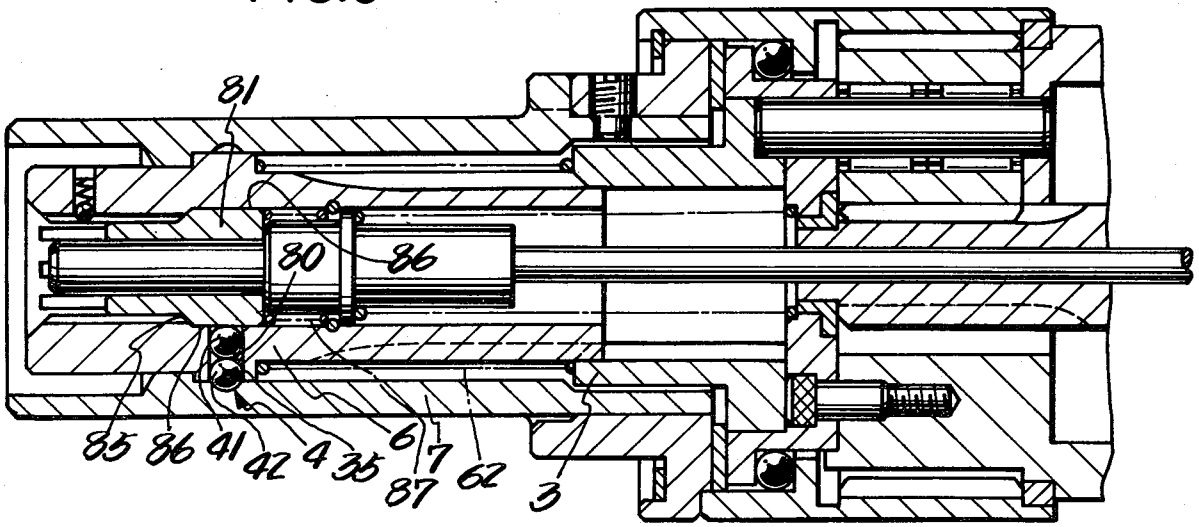

FIGS. 9 and 10 show other embodiments of the invention each comprising a short holder 3 and an outer socket 7 internally formed with a bearing face 35 for stoppers 4.

In the case of FIG. 9, two steel balls 41, 42 are rotatably fitted in a hole 80 in the side wall of an inner socket 6, the outer steel ball 42 serving as a stopper 4. The outer socket 7 is formed on the inner side thereof with a bearing face 35 defining a circumferential groove and engageable with the stopper 4. When a tubular rod 81 biased by a spring 87 is in its advanced position as in the foregoing embodiment, the inner steel ball 41 rides on an engaging face 86 of the tubular rod 81, with the outer ball 42 in engagement with the bearing face 35, whereby the inner socket 6 is prevented from retraction. When the tubular rod 81 is retracted against a spring 62 by being pushed by a bolt tip 91, the inner steel ball 41 slides along a cam face 85 on the tubular rod 81 inwardly thereof, consequently permitting the outer steel ball 42 to disengage from the bearing face 35 to allow the retraction of the inner socket 6.

According to the embodiment shown in FIG. 10, an inner socket 6 is formed in its side wall with a hole 80 having slidably fitted therein a stopper 4 having rounded ends and a length slightly larger than the thickness of the side wall. A tubular rod 81 is formed in its outer periphery with a circumferential groove 88 in which the stopper 4 is engageable, while the outer socket 7 has on the inner side thereof a bearing face 35 with which the stopper 4 is engageable. When the tubular rod 81, biased by a spring 87, is in its advanced position, the stopper 4 is in contact with the outer periphery of the tubular rod 81 and in an outward position in engagement with the bearing face 35 of the outer socket 7, holding the inner socket 6 against retraction.

When the tubular rod 81 is retracted against a spring 62 by being pushed by a bolt tip 91, the stopper 4 becomes engageable in the circumferential groove 88 in the rod 81, with the result that the stopper 4 moves inward out of engagement with the bearing face 35, permitting the retraction of the inner socket 6.

According to the invention described above, the stoppers 4 for restraining the retraction of the inner socket 6 are not disengageable and prevent the nut 92 from fitting into the bore 70 of the outer socket 7 unless the bolt tip 91 is fully fitted into the bore 60 of the inner socket 6 to retract the tubular rod 81, so that unlike the conventional device, the present device will not operate for fastening before the bolt tip is completely fitted into the inner socket. Moreover bolts can be fastened with safety. Thus the present invention is very useful for industries.

What is claimed is:

1. A bolt fastening device comprising an outer socket having a nut engaging bore at its forward end, a tubular holder fitted in the outer socket rotatably independently of rotation of the outer socket, the outer socket and the holder being coupled to a drive assembly for subjecting the socket and the holder to torque acting in directions opposite to each other, an inner socket axially slidably fitted in the holder and rotatable with the holder, the inner socket being formed at its forward end with a bore for engaging therein a tip of a bolt to be sheared therefrom, characterized with a tubular rod inserted in the inner socket and biased by a spring to project into and retract from the tip engaging bore, a stopper retractable into a hole extending through the side wall of the inner socket and projectable from the hole toward a bearing face positioned outside the inner socket, the stopper being outwardly pushable into engagement with the bearing face when the tubular rod is brought to an advanced position, the stopper being retractable from the bearing face when the tubular rod is in a retracted position, and a knockout pin slidably fitted in the tubular rod.

2. A bolt fastening device as defined in claim 1 wherein the inner socket is formed with a plurality of projections arranged equidistantly on its outer periphery and slidably fitting in a plurality of grooves formed in the inner surface of the holder.

3. A bolt fastening device as defined in claim 1 wherein the drive assembly comprises a motor and planetary gear means including a sun gear coupled to the shaft of the motor, an inner gear connected to the outer socket and planetary gears each having a shaft projecting therefrom, the planetary gear shaft being loosedly fitted in a circumferential cutout formed in an end face of the holder.

4. A bolt fastening device as defined in claim 1 wherein the forward end of the holder is positioned forwardly of the stopper when the tubular rod is in its advanced position, and the bearing face is formed on the inner side of the holder.

5. A bolt fastening device as defined in claim 1 wherein the forward end of the holder is positioned rearwardly of the stopper when the tubular rod is in its advanced position, and the bearing face is formed on the inner surface of the outer socket.

* * * * *